US012123669B2

(12) United States Patent
Noonan et al.

(10) Patent No.: US 12,123,669 B2
(45) **Date of Patent: *Oct. 22, 2024**

(54) THUMB SAFETY MECHANISM

(71) Applicants: Paul T. Noonan, Boise, ID (US); Tingwu Song, Palos Verdes, CA (US); Aaron Neal Trout, Fayetteville, AR (US)

(72) Inventors: Paul T. Noonan, Boise, ID (US); Tingwu Song, Palos Verdes, CA (US); Aaron Neal Trout, Fayetteville, AR (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/687,879

(22) Filed: Mar. 7, 2022

(65) Prior Publication Data

US 2022/0187040 A1 Jun. 16, 2022

Related U.S. Application Data

(63) Continuation of application No. 16/250,185, filed on Jan. 17, 2019, now Pat. No. 11,300,376.

(60) Provisional application No. 62/618,686, filed on Jan. 18, 2018.

(51) Int. Cl.
*F41A 17/74* (2006.01)
*F41A 35/06* (2006.01)

(52) U.S. Cl.
CPC ..... *F41A 17/74* (2013.01); *F41A 35/06* (2013.01)

(58) Field of Classification Search
CPC ..... F41A 17/74; F41A 17/42
See application file for complete search history.

(56) References Cited

U.S. PATENT DOCUMENTS

| | | | | | |
|---|---|---|---|---|---|
| 3,492,748 | A * | 2/1970 | Swenson | F41A 17/00 | 42/70.01 |
| 4,414,769 | A * | 11/1983 | Mueschke | F41A 17/00 | 42/70.01 |
| 5,212,327 | A * | 5/1993 | Schuemann | F41A 35/06 | 42/70.01 |
| 5,903,994 | A * | 5/1999 | Tange | F41A 17/00 | 42/70.01 |
| 8,276,502 | B1 * | 10/2012 | Wright | F41A 35/06 | 42/70.08 |
| 8,333,028 | B1 * | 12/2012 | Karfiol | F41A 17/56 | 42/70.01 |
| 9,587,897 | B1 * | 3/2017 | Huang | F41A 17/70 | |
| 2013/0152444 | A1 * | 6/2013 | Tatum | F41A 17/56 | 42/70.01 |
| 2014/0259846 | A1 * | 9/2014 | Joubert | F41A 17/56 | 42/70.11 |
| 2017/0122689 | A1 * | 5/2017 | Smith | F41A 35/06 | |

OTHER PUBLICATIONS

Mini-Draco AK-47 Pistol Review. Man, Tin. <https://web.archive.org/web/20150322083453/https://blacksheepwarrior.com/mini-draco-ak-47-pistol-review/>. Mar. 22, 2015. (Year: 2015).*

* cited by examiner

*Primary Examiner* — Gabriel J. Klein

(57) ABSTRACT

A thumb safety mechanism is disclosed. The thumb safety mechanism contains a first main body containing an inner side surface, a pivot member containing a first end coupled with the inner side surface of the first main body by a fastener; and an engagement member protruding from the inner side surface of the first main body.

9 Claims, 5 Drawing Sheets

THUMB SAFETY MECHANISM

CROSS REFERENCE TO RELATED APPLICATIONS

This application is a continuation of U.S. patent application Ser. No. 16/250,185 titled "Thumb Safety Mechanism-"filed Jan. 17, 2019, now issued U.S. Pat. No. 11,300,376, which is incorporated herein by reference in its entirety. The U.S. patent application Ser. No. 16/250,185 claims the benefit of U.S. Provisional Application No. 62/618,686, filed on Jan. 18, 2018, which is incorporated herein by reference in its entirety.

FIELD

The present invention relates to firearms. More particularly, the present invention relates to a thumb safety mechanism for a firearm.

BACKGROUND

The Model 1911 handgun is one of the most well-known and widely used handguns. Despite its popularity and long-standing use, there still exist drawbacks with this firearm. In particular, as a safety feature, most Model 1911's have a thumb safety located near the grip of the firearm adjacent the rear end thereof. The thumb safety generally is rotatable into a position wherein it will block the operation of the hammer and sear of the firearm.

However, thumb safety known in the art is complicated. and expensive to manufacture. Accordingly, a need exists for an improved thumb safety mechanism that addresses the foregoing and other related and unrelated problems in the art.

Figure 1:
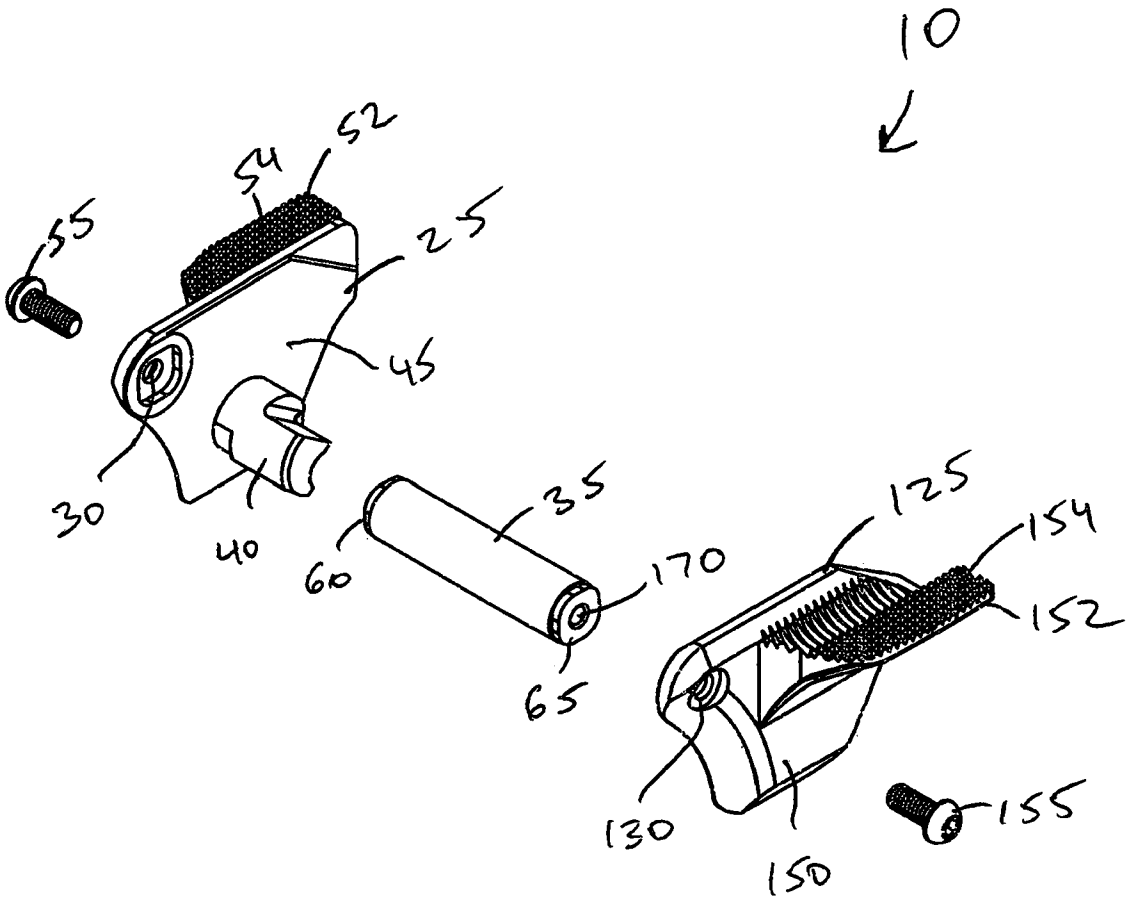
FIG. 1 depicts an exploded view of a thumb safety mechanism according to some embodiments presently disclosed.

In the following description, like reference numbers are used to identify like elements. Furthermore, the drawings are intended to illustrate major features of exemplary embodiments in a diagrammatic manner. The drawings are not intended to depict every feature of every implementation nor relative dimensions of the depicted elements, and are not drawn to scale.

DETAILED DESCRIPTION

In the following description, numerous specific details are set forth to clearly describe various specific embodiments disclosed herein. One skilled in the art, however, will understand that the presently claimed invention may be practiced without all of the specific details discussed below. In other instances, well known features have not been described so as not to obscure the invention. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings. Referring to FIGS. 1-4, a thumb safety mechanism 10 for blocking or otherwise preventing operation of a hammer 15 in the firearm 20 is shown according to some embodiments presently disclosed. According to some embodiments presently disclosed, the thumb safety mechanism 10 comprises a first main body 25, a through opening (i.e. aperture) 30, a pivot member 35, and an engagement member 40. The first main body 25 comprises an inner side surface 45 (shown in FIGS. 1-2) configured to engage and ride over or along the frame 22 (shown in FIG. 4) of the firearm 20. The first main body 25 further comprises an outer side surface 50 (shown in FIG. 3) that is opposite the inner side surface 45. According to some embodiments presently disclosed, the pivot member 35 comprises a first end 60 and a second end 65. According to some embodiments presently disclosed, the first end 60 comprises an opening (i.e. aperture) 70. According to some embodiments presently disclosed, the inner side surface 45 of first main body 25 is coupled with the first end 60 of the pivot member 35 (shown in FIGS. 2-3) using, for example, a fastener 55 (shown in FIGS. 1 and 3). The fastener 55 may be a pin, a screw, a setscrew, a full dog point set screw, or a dogleg set screw. The through opening 30 and the opening 70 are configured to accommodate the fastener 55.

According to some embodiments presently disclosed, the firearm 20 comprises an opening (i.e. aperture) 72 (shown in FIG. 4) configured to accommodate the second end 65 of the pivot member 35. According to some embodiments presently disclosed, once inserted in to the opening 72 of the firearm 20, the first main body 25 is configured to move from a first (fire) position to a second (safe) position and back to the first (fire) position. According to some embodiments presently disclosed, once inserted in to the opening 72 of the firearm 20, the first main body 25 is configured to pivot from a first (fire) position to a second (safe) position and back to the first (fire) position. According to some embodiments presently disclosed, once inserted in to the opening 72 of the firearm 20, the first main body 25 is configured to pivot about the pivot member 35 from a first (fire) position to a second (safe) position and back to the first (fire) position.

According to some embodiments presently disclosed, when the first main body 25 is in the first (fire) position, the hammer 15 is not blocked and the firearm 20 is able to fire ammunition. When the first main body 25 is in the second (safe) position, the hammer 15 is blocked or otherwise prevented from operating and the firearm 20 is unable to fire ammunition. According to some embodiments presently disclosed, the inner side surface 45 of first main body 25 is coupled with the engagement member 40. According to some embodiments presently disclosed, the inner side surface 45 of first main body 25 is coupled with the engagement member 40 using, for example, a fastener (not shown). According to some embodiments presently disclosed, the engagement member 40 extends from the inner side surface 45 of first main body 25.

According to some embodiments presently disclosed, the firearm 20 comprises an opening (i.e. aperture) 74 configured to accommodate the engagement member 40 when the pivot member 35 is inserted into the opening 72. According to some embodiments presently disclosed, the engagement member 40 comprises a series of angled engagement features or surfaces 75-76 configured to engage internal features of the firearm 20 to block or otherwise prevent operation of the hammer 15 when the first main body 25 is in the second (safe) position. According to some embodiments presently disclosed, the outer side surface 50 of first main body 25 is coupled with a tab member 52. According to some embodiments presently disclosed, the outer side surface 50 of first main body 25 is coupled with the tab member 52 using, for example, a fastener (not shown). According to some embodiments presently disclosed, the tab member 52 extends from the outer side surface 50 of first main body 25. The tab member 52 is configured to allow a user' thumb to move the first main body 25 from the first (fire) position to the second (safe) position and back top the first (fire) position. The tab member 52 may comprise surface features 54 formed there along to facilitate better gripping and engagement by the user's thumb.

According to some embodiments presently disclosed, the thumb safety mechanism 10 may further comprise a second main body 125 to allow ambidextrous operation of the thumb safety mechanism 10. According to some embodiments presently disclosed, the second main body 125 comprises a through opening (i.e. aperture) 130 shown in FIGS. 1 and 4. The second main body 125 comprises an inner side surface 145 (shown in FIG. 3) configured to engage and ride over or along the firearm 20. The second main body 125 further comprises an outer side surface 150 (shown in FIGS. 1-3) that is opposite the inner side surface 145.

According to some embodiments presently disclosed, the second end 65 of the pivot member 35 comprises an opening (i.e. aperture) 170 (shown in FIG. 1).

Figure 2:
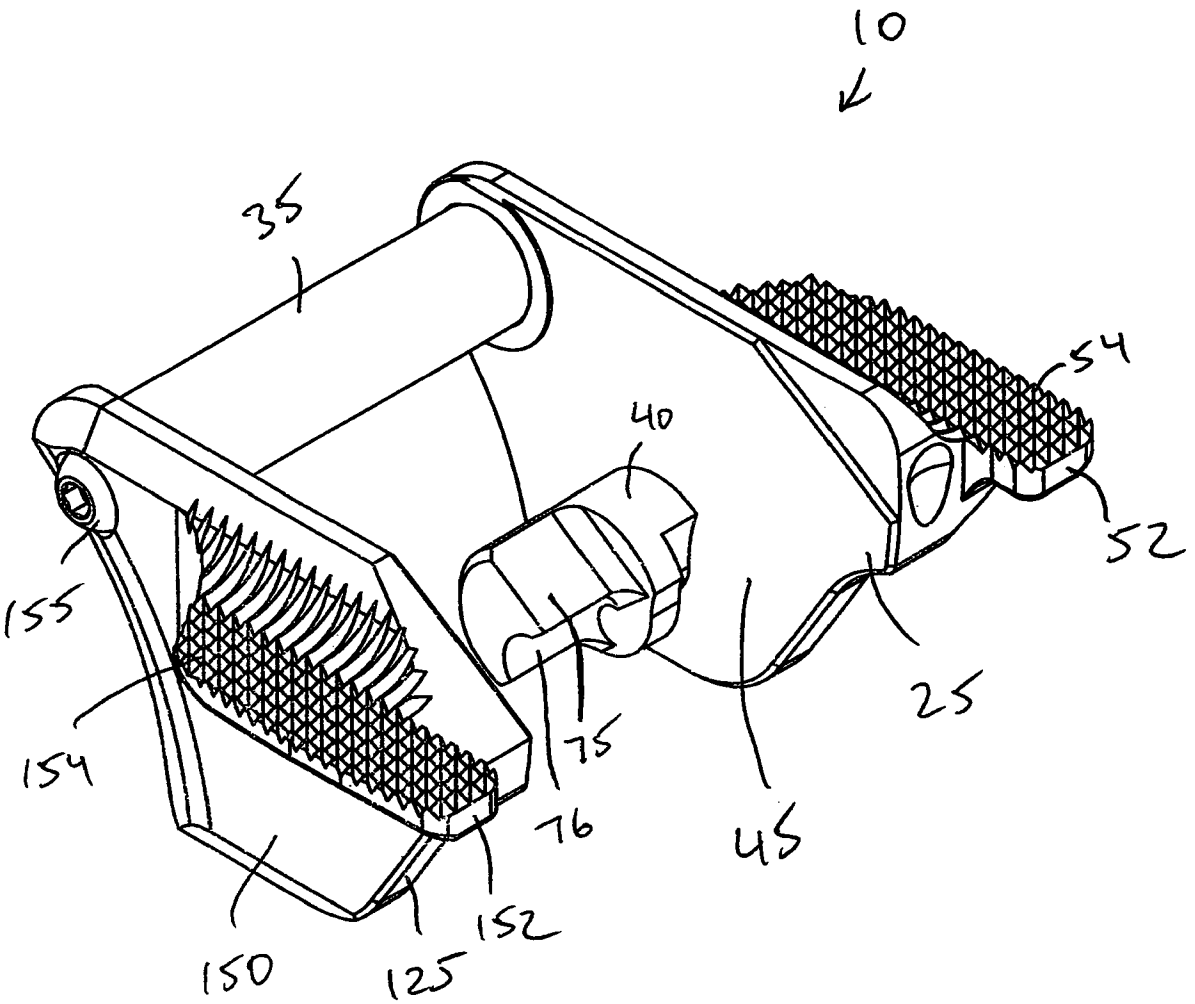
FIG. 2 depicts an prospective view of the thumb safety mechanism shown in FIG. 1.
Figure 3:
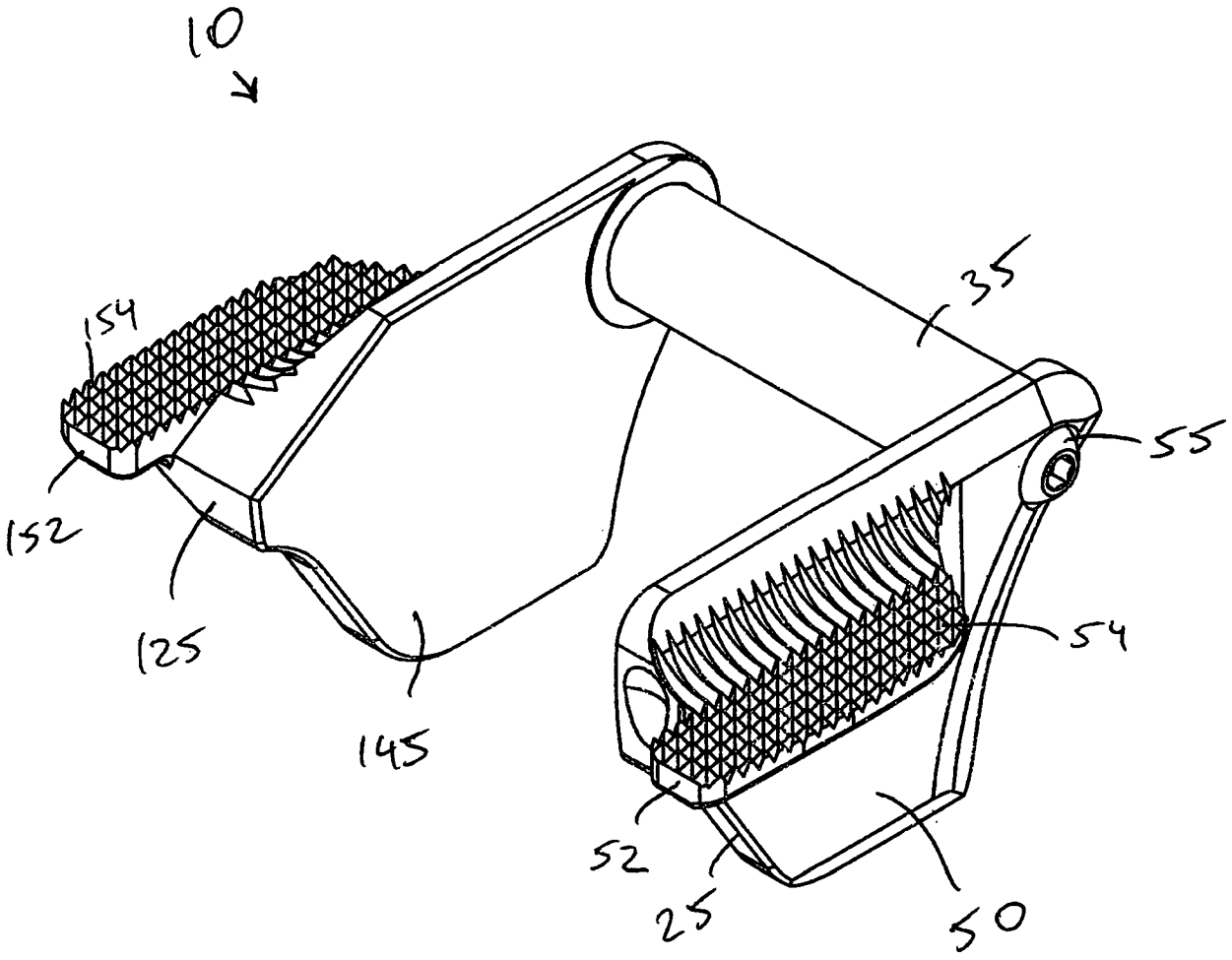
FIG. 3 depicts another prospective view of the thumb safety mechanism shown in FIG. 1.
Figure 4:
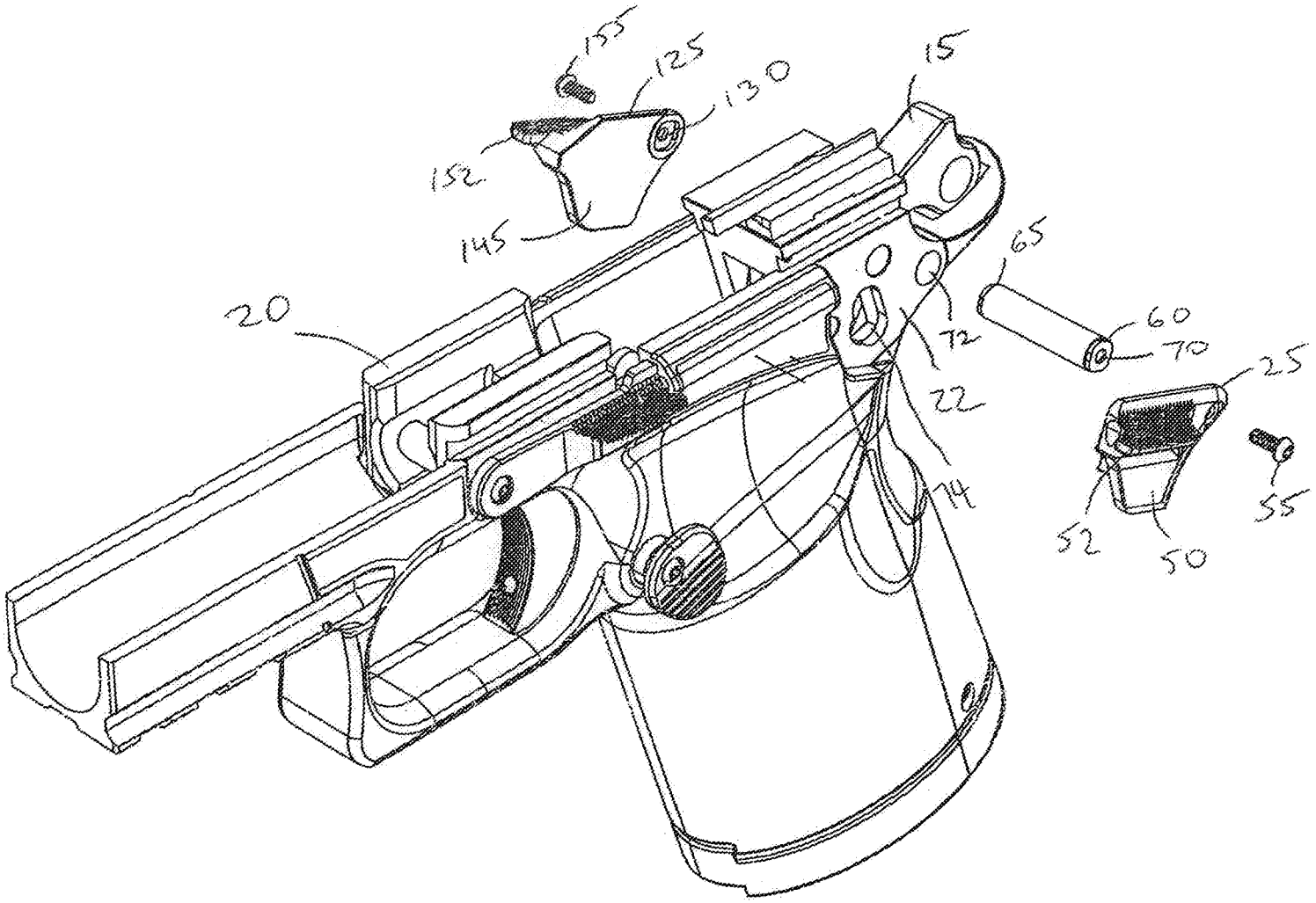
FIG. 4 depicts a thumb safety mechanism according to some embodiments presently disclosed.

According to some embodiments presently disclosed, the inner side surface 145 of second main body 125 is coupled with the second end 65 of the pivot member 35 (shown in FIGS. 2-3) using, for example, a fastener 155 (shown in FIGS. 1 and 2). The fastener 155 may be a pin, a screw, a setscrew, a full dog point set screw, or a dogleg set screw. The through opening 130 and the opening 170 are configured to accommodate the fastener 155.

According to some embodiments presently disclosed, the aperture 72 of the firearm 20 is a through opening configured to allow the pivot member 35 to go though the frame 22 of the firearm 20. According to some embodiments presently disclosed, once inserted in to the opening 72 of the firearm 20, the first main body 25 and the second main body 125 are configured to move from the first (fire) position to the second (safe) position and back to the first (fire) position. According to some embodiments presently disclosed, once inserted in to the opening 72 of the firearm 20, the first main body 25 and the second main body 125 are configured to pivot from the first (fire) position to the second (safe) position and back to the first (fire) position. According to some embodiments presently disclosed, once inserted in to the opening 72 of the firearm 20, the first main body 25 and the second main body 125 are configured to pivot about the pivot member 35 from the first (fire) position to the second (safe) position and back to the first (fire) position.

According to some embodiments presently disclosed, when the first main body 25 and the second main body 125 are in the first (fire) position, the hammer 15 is not blocked and the firearm 20 is able to fire ammunition. When the first main body 25 and the second main body 125 are in the second (safe) position, the hammer 15 is blocked or otherwise prevented from operating and the firearm 20 is unable to fire ammunition.

According to some embodiments presently disclosed, the outer side surface 150 of second main body 125 is coupled with a tab member 152. According to some embodiments presently disclosed, the outer side surface 150 of second main body 125 is coupled with the tab member 152 using, for example, a fastener (not shown). According to some embodiments presently disclosed, the tab member 152 extends from the outer side surface 150 of second main body 125. The tab member 152 is configured to allow the user' thumb to move the second main body 125 from the first (fire) position to the second (safe) position and back top the first (fire) position. The tab member 152 may comprise surface features 154 formed there along to facilitate better gripping and engagement by the user's thumb.

Figure 5:
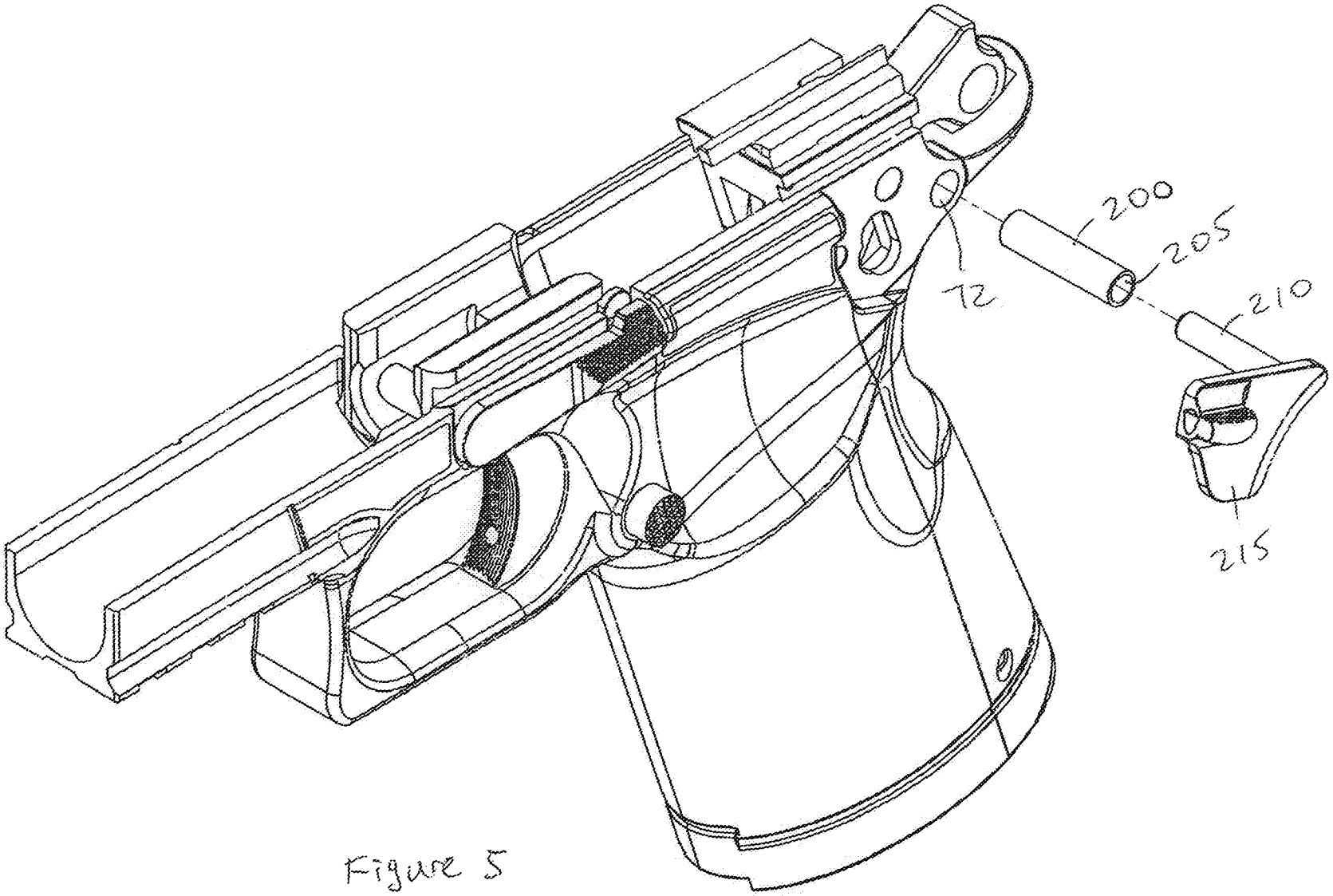
FIG. 5 depicts an adapter member according to some embodiments presently disclosed.

Referring to FIG. 5, an adapter member 200 is shown according to the present disclosure. According to some embodiments presently disclosed, the adapter member 200 is configured to be inserted into the opening 72. According to some embodiments presently disclosed, the opening 72 is configured to accommodate the adapter member 200. According to some embodiments presently disclosed, the adapter member 200 comprises an opening 205 configured to accommodate a pin 210 of a thumb safety mechanism 215. According to some embodiments presently disclosed, the pin 210 is integral to the thumb safety mechanism 215.

The adapter member 200 may be used when the opening 72 is larger than the pin 210. According to some embodiments presently disclosed, the adapter member 200 is a cylinder.

Although the thumb safety mechanism 10 is shown being applied to a Model 1911 type firearm 20 (FIG. 4), it is to be understood that the thumb safety mechanism 10 can be applied to other types of firearms.

According to some embodiments presently disclosed, the first main body 25 and/or the second main body 125 are made from casted material. According to some embodiments presently disclosed, the first main body 25 and/or the second main body 125 are injection molded.

While several illustrative embodiments of the invention have been shown and described, numerous variations and alternative embodiments will occur to those skilled in the art. Such variations and alternative embodiments are contemplated, and can be made without departing from the scope of the invention as defined in the appended claims.

As used in this specification and the appended claims, the singular forms "a," "an," and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains.

What is claimed is:

1. A thumb safety mechanism comprising:

a first main body comprising an inner side surface;

a pivot member comprising a first end coupled with the inner side surface of the first main body by a fastener, wherein the first main body is configured to pivot about the pivot member from a fire position to a safe position;

a removable cylinder, wherein the removable cylinder comprises an opening configured to accommodate the pivot member;

a second main body coupled with a second end of the pivot member by another fastener; and an engagement member protruding from the inner side surface of the first main body;

wherein the pivot member is a monolithic piece of material that extends from the inner side surface of the first main body to the second main body;

wherein the thumb safety mechanism is a semiautomatic pistol thumb safety mechanism.

2. The thumb safety mechanism of claim 1, wherein the fastener is a screw and the another fastener is another screw.

3. The thumb safety mechanism of claim 1, wherein the engagement member is configured to block operation of a hammer when the first main body is in the safe position.

4. The thumb safety mechanism of claim 1, wherein the engagement member and the first main body form a monolithic structure.

5. The thumb safety mechanism of claim 1, wherein the thumb safety mechanism is a model 1911 firearm thumb safety mechanism.

6. A thumb safety mechanism coupled to a frame of a semiautomatic pistol, the thumb safety mechanism comprising:

a first main body comprising an inner side surface;

a pivot member comprising a first end coupled with the inner side surface of the first main body by a fastener;

a removable cylinder, wherein the removable cylinder comprises an opening configured to accommodate the pivot member;

a second main body comprising an inner side surface, wherein the pivot member comprises a second end coupled with the inner side surface of the second main body by another fastener, wherein the pivot member is a monolithic piece of material that extends from the inner side surface of the first main body to the inner side surface of the second main body; and an engagement member protruding from the inner side surface of the first main body;

wherein thumb safety mechanism is movably mounted to the frame of the semiautomatic pistol so that the first main body is movable between a fire position and a safe position, wherein actuation of the semiautomatic pistol is prevented when the first main body is in the safe position.

7. The thumb safety mechanism of claim 6, wherein the frame comprises an aperture for engaging the pivot member when the first main body is moved between the fire position and the safe position.

8. The thumb safety mechanism of claim 6, wherein the engagement member is configured to block operation of a hammer of the semiautomatic pistol when the first main body is in the safe position.

9. The thumb safety mechanism of claim 6, wherein the semiautomatic pistol is a model 1911 firearm.

* * * * *